United States Patent [19]

Moser

[11] 4,306,450

[45] Dec. 22, 1981

[54] APPARATUS FOR MEASURING A CROSS-SECTIONAL AREA OF A TRAVELLING FIBER SLIVER

[75] Inventor: Robert Moser, Winterthur, Switzerland

[73] Assignee: Rieter Machine Works, Ltd., Winterthur

[21] Appl. No.: 84,893

[22] Filed: Oct. 15, 1979

[51] Int. Cl.[3] ..... D01H 5/52; D02G 1/12

[52] U.S. Cl. ..... 73/160; 19/239; 28/250; 73/37.7

[58] Field of Search ..... 73/160, 37.7, 861.63, 73/861.52; 19/239, 240; 28/273, 274, 267, 250, 276

[56] References Cited

U.S. PATENT DOCUMENTS

| | | | |
|---|---|---|---|
| B 532,319 | 2/1976 | Stern | 73/37.7 |
| 2,669,246 | 2/1954 | Segerstad | 73/37.7 X |
| 3,435,673 | 4/1969 | Felix | 19/239 X |
| 3,752,170 | 8/1973 | Murbach | 73/37.7 X |
| 3,892,951 | 7/1975 | Stutz | 73/160 X |
| 4,074,573 | 2/1978 | Nordhofen | 73/861.52 |
| 4,075,739 | 2/1978 | Staheli | 19/240 |

*Primary Examiner*—Daniel M. Yasich

*Attorney, Agent, or Firm*—Kenyon & Kenyon

[57] ABSTRACT

The apparatus permits establishment of measuring values, yielding measuring values being representative of the material cross-section area solely of fiber slivers. A through-put duct converging, as seen, in the direction of transport of the fiber sliver is used into which two pressure measuring ducts merge at two measuring points at which the duct diameter is different. The two measuring ducts transmit measuring signals which are further processed in a division circuit means, which yields an output signal. The output signal is used for fiber sliver control or measuring purposes on machines processing fiber slivers or on spinning machines processing such fiber slivers further.

6 Claims, 3 Drawing Figures

APPARATUS FOR MEASURING A CROSS-SECTIONAL AREA OF A TRAVELLING FIBER SLIVER

This invention relates to an apparatus for establishing measuring values for a travelling fiber sliver. More particularly, this invention relates to an apparatus for establishing measuring values corresponding to a material cross-sectional area of a travelling fiber sliver.

As is known, various types of devices have been known for obtaining measuring values corresponding to the material cross-sectional area of a fiber sliver transported through a duct. For example, Swiss Pat. No. 436,779 describes an apparatus wherein a hollow room or space is disposed in a throughput measuring duct between consecutively arranged planes extending at right angles with respect to the axis of the duct and to which a manometer is connected. During use, the manometer serves to measure the pressure within the hollow space and a measuring value is generated corresponding to the material cross-sectional area of a fiber sliver transported through the duct. This apparatus, however, has a serious disadvantage in that the measuring value does not solely depend on the material cross-sectional area of the fiber sliver. That is, the measurement value also depends upon the throughput speed of the fiber sliver, the fiber shape and the fiber fineness. Thus, the apparatus yields a biased measure of the material cross-sectional area of the fiber sliver.

Accordingly, it is an object of the invention to provide an apparatus for producing a measuring value of a fiber sliver which depends solely on the material cross-sectional area of the fiber sliver.

It is another object of the invention to provide an apparatus of simple construction for emitting signals corresponding to the actual material cross-sectional area of a travelling fiber sliver.

Briefly, the invention is directed to an apparatus for establishing measuring values corresponding to a material cross-sectional area of a travelling fiber sliver. The apparatus is comprised of a pneumatic measuring duct having a converging cross-section for passage of a travelling fiber sliver therethrough, a pair of pneumatic pressure measuring ducts and a division circuit means connected to the pressure measuring ducts. The pressure measuring ducts communicate with a respective one of a pair of measuring points in the duct at different cross-sections of the duct in order to measure the pressure thereat during travel of a fiber sliver therethrough. The division circuit means serves to receive transduced pressure measurements from the pair of measuring ducts and to divide one pressure measurement into the other in order to obtain an output signal corresponding thereto. This output signal forms a measuring value of the material-cross-sectional area of the travelling fiber sliver.

The division circuit means includes a pair of transducers for converting the pressure measurements into electrical signals and an electronic division device for dividing the signals. To this end, each transducer is connected to a respective one of the pressure measuring ducts to transform a measured pressure into a proportional voltage signal. The electronic division device is connected to the two transducers to receive the respective voltage signals and serves to form a quotient of the received signals for emission as an output signal.

The apparatus is particularly useful in obtaining values of a travelling fiber sliver which is processed in a spinning preparation.

These and other objects and advantages of the invention will become more apparent from the following detailed description and appended claims taken in conjunction with the accompanying drawings in which:

Surprisingly, it has been found that if a fiber sliver is transported through two pneumatic measuring ducts, if the pressure in each duct is measured and if the two measuring signals are divided, a signal corresponding to the material cross-sectional area of the fiber sliver results which is independent of the throughput speed of the fiber sliver, the fiber shape and the fiber fineness.

Figure 1:
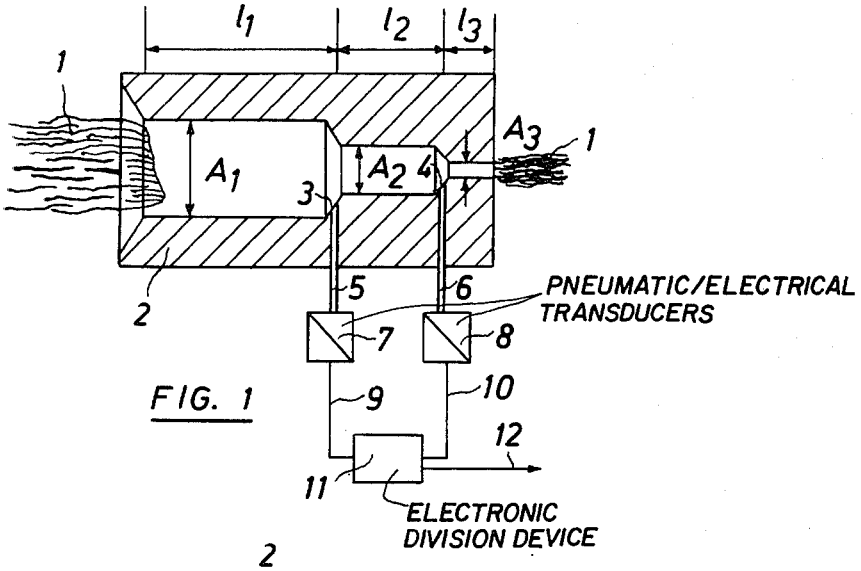
FIG. 1 illustrates an apparatus in accordance with the invention having a pneumatic measuring duct in the form of a stepped funnel.

The apparatus shown in FIG. 1 makes use of these findings. As shown, the apparatus for establishing measuring values corresponding to a material cross-sectional area of a travelling fiber sliver 1 includes a one piece hollow body 2 in which a pneumatic measuring duct is disposed. As illustrated, the duct, in principle, consists of two combined step funnels. One funnel is of the length $l_1$, $l_2$ and of the cross-sectional areas $A_1$, $A_2$. The other funnel is of the length $l_2$, $l_3$ and of the cross-sectional areas $A_2$, $A_3$. The length $l_2$ and the cross-sectional area $A_2$, thus, is common to both funnels. As illustrated, the measuring duct has a converging cross-section in the direction of travel of the fiber sliver 1.

In addition, the apparatus includes a pair of pneumatic measuring ducts 5, 6 which communicate with a respective pair of measuring points 3, 4 in the duct at different cross-sections of the duct. As shown, the measuring points 3, 4 are provided at each narrowing point between the straight funnel sections. These pneumatic ducts 5, 6 serve to measure the pressure at the measuring points 3, 4 during travel of the fiber sliver 1 through the duct.

Also, the apparatus has a division circuit means of known construction connected to the pressure measuring ducts 5, 6 to receive the pressure measurements and to divide one pressure measurement into the other in order to obtain an output signal corresponding thereto. This division circuit means includes a pair of pneumatic-electric transducers 7, 8 and an electronic division device 11. Each transducer 7, 8 is connected to a respective pneumatic duct 5, 6 and functions so that the pressure measured by the duct 5, 6 is transformed into a proportional voltage signal. The transducers 7, 8 are, in turn, connected via electrical circuits 9, 10 with the electronic division device 11 to deliver the proportional voltage signals thereto. The division device 11, in turn receives the voltage signals and forms a quotient thereof for emission as an output signal 12.

During operation, the pneumatic pressure p scanned at the measuring points 3, 4 is transformed by the transducers 7, 8 into proportional voltages U. Both voltages are subsequently transmitted to the division circuit device 11 where their quotient is formed. The output signal 12 is a voltage U (t) depending on the momentaneous titer (or linear density) of the fiber sliver 1, which is proportional to the quotient of the two pressures p and thus forms a measuring value of the material cross-sectional area of the fiber sliver 1. This measuring value now is not influenced by the throughput speed of the fiber sliver nor by the fiber shape, nor by the fiber fineness, and thus is suitable for controlling purposes, or can easily be transformed by suitable transformation into a measure normally used for the material cross-sectional of the fiber sliver 1.

The apparatus may take other forms than the step funnel according to FIG. 1, as the elimination of the biasing influences due to the quotient formation does not depend on the funnel shape. Thus, a converging funnel of any desired shape can be used as a throughput duct for the fiber sliver into which the two measuring ducts 5, 6 merge at points of differing duct cross-sectional area.

It is advantageous that the funnel shapes do not contain, if possible, abrupt changes in cross-section area so that the position of the fibers in the fiber array remains as undisturbed as possible. It also is possible to have a pair of consecutively arranged hollow bodies or funnels define the throughput measuring duct with each funnel being provided with a measuring point.

Furthermore, it proves advantageous to connect the measuring ducts 5, 6 at locations in the funnel which differ widely in duct cross-section area.

Figure 2:
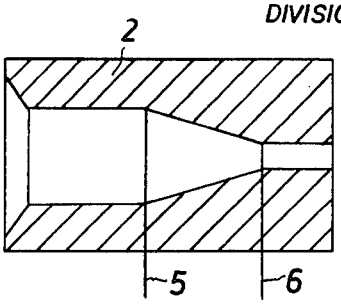
FIG. 2 illustrates a modified pneumatic measuring duct in accordance with the invention.
Figure 3:
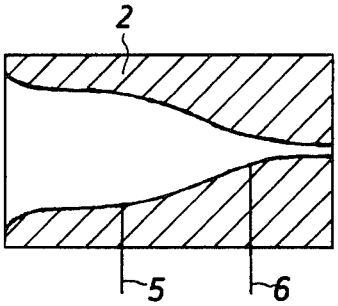
FIG. 3 illustrates a cross-sectional view of a further modified pneumatic measuring duct in accordance with the invention.

Referring to FIGS. 2 and 3, wherein like reference characters indicate like parts as above, the pneumatic measuring duct may alternatively include, for example a conical fiber throughput duct section between two cylindrical sections (FIG. 2) or may be of a continuously decreasing cross-section i.e. with a curved convergence, in the direction of fiber sliver travel.

What is claimed is:

1. An apparatus for establishing measuring values corresponding to a material cross-sectional area of a travelling fiber sliver, said apparatus comprising a first pneumatic measuring duct having a converging cross-section for passage of a travelling fiber sliver therethrough;

a pair of pneumatic pressure measuring ducts communicating with a respective pair of measuring points in said first duct at different cross-sections of said first duct to measure the pressure thereat during travel of a fiber sliver therethrough; and a division circuit means connected to said pair of transduced pressure measuring ducts to receive pressure measurements therefrom and to divide one pressure measurement into the other to obtain an output signal corresponding thereto, said output signal forming a measuring value of the material cross-sectional area of the travelling fiber sliver.

2. An apparatus as set forth in claim 1 wherein said division circuit means includes a pair of transducers and an electronic division device, each said transducer being connected to a respective one of said pressure measuring ducts to transform a measured pressure into a proportional voltage signal and said device is connected to said transducers to receive said voltage signals and form a quotient thereof as said output signal.

3. An apparatus as set forth in claim 1 wherein said pneumatic measuring duct is part of a one-piece hollow body.

4. An apparatus as set forth in claim 3 wherein said pneumatic measuring duct includes a conical section between two cylindrical sections.

5. An apparatus as set forth in claim 3 wherein said pneumatic measuring duct is of a continuously decreasing cross-section.

6. An apparatus as set forth in claim 1 wherein a pair of consecutively arranged hollow bodies define said pneumatic measuring duct.

* * * * *